US008491448B2

(12) United States Patent
Emick

(10) Patent No.: US 8,491,448 B2
(45) Date of Patent: Jul. 23, 2013

(54) HEMISPERICAL GRIP HANDLE APPARATUS

(76) Inventor: Daniel W. Emick, Montoursville, PA (US)

( * ) Notice: Subject to any disclaimer, the term of this patent is extended or adjusted under 35 U.S.C. 154(b) by 304 days.

(21) Appl. No.: 13/065,803

(22) Filed: Mar. 29, 2011

(65) Prior Publication Data

US 2011/0245050 A1 Oct. 6, 2011

Related U.S. Application Data

(60) Provisional application No. 61/341,404, filed on Mar. 31, 2010.

(51) Int. Cl.
*A63B 21/00* (2006.01)

(52) U.S. Cl.
USPC ..... 482/49; 482/48; 482/110; 482/102

(58) Field of Classification Search
USPC ..... 482/49, 48, 102, 103, 108, 109
See application file for complete search history.

(56) References Cited

U.S. PATENT DOCUMENTS

| | | | | |
|---|---|---|---|---|
| 1,930,342 | A * | 10/1933 | Graham | 473/232 |
| 5,158,517 | A * | 10/1992 | Steggert | 482/98 |
| 5,498,221 | A * | 3/1996 | Blair, Jr. | 482/99 |
| 8,172,727 | B2 * | 5/2012 | Berman et al. | 482/44 |
| 8,382,647 | B1 * | 2/2013 | Hodes et al. | 482/108 |

* cited by examiner

*Primary Examiner* — Jerome W Donnelly
(74) *Attorney, Agent, or Firm* — Thomas R. Shaffer

(57) ABSTRACT

A hemispherical grip member has an outer hemispherical surface and a grip layer and a grip member opening. A length of aircraft cable having a first cable end extends through the opening and is crimped in position onto the grip member with a cable nut. A connector is provided on an opposite cable end. A length of a soft flexible tubing surrounds the cable between the grip member and the connector. When a user grasps the hemispherical surface of the grip member, the first cable end is located inside the grasp of the user and the cable and tubing passes between two fingers of the user.

17 Claims, 9 Drawing Sheets

PRIOR ART

HEMISPERICAL GRIP HANDLE APPARATUS

This application claims priority from the disclosure made in Provisional Patent Application No. 61/341,404 filed Mar. 31, 2010.

BACKGROUND OF THE INVENTION

1. Field of the Invention

The present invention relates to a hemispherical grip handle apparatus. More specifically it relates to a unique grip handle which effectively and comfortably replaces and improves the griping interface between a user and various exercise devices.

2. Description of the Prior Art

A variety of handles have been proposed for use with exercise devices or as a way to connect a handle to a cable or wire rope.

Many existing cable handles are commonly referred to as stirrups because of their resemblance to the same. These handles are simply handles which attach to cable weight stack machines in order that exercisers may utilize the machine for a variety of popular exercises. Existing cable handles are typically formed of a solid round steel rod shaped into 3 or 4 sided square or triangular configurations. The top of the existing cable handles feature a fixed or swiveling hook location for snap hook attachment to exercise machines, as well as a spinning tubular handle for gripping at the bottom of the unit. The benefits of the existing stirrup type cable are that they are of indestructible simplicity in form and function. Drawbacks associated with these existing cable handles are the heavy weight of the units due to the solid steel construction and, in addition, metal on metal contact squeaks generated by the spinning handles. Additionally, control of the units is less than optimal due to the location of the cable handle attachment points some distance away from the gripping point. Lastly, due in large part to limitations of snap hook, machine cable and cable handle attachment hole inflexibility, optimal freedom of movement during exercise is not made possible. This also applies to user movement limitations as defined by implements fixed components.

Roberts, U.S. Pat. No. 5,556,369 shows in FIG. 1 a cable handle which allows the user to grip and pull in the same longitudinal direction as the cable. FIG. 2 shows one possible triangular stirrup type arrangement of the general type described above.

Schaber, U.S. Pat. No. 5,533,952 discloses a single handle which can be used to grip and pull longitudinally to the cable as shown in FIG. 4 or by wrapping the cable around the anchor point 2 on the handle grip assembly 9 to grip and pull transversely to the cable as shown in FIG. 6.

Hauser et al., U.S. Pat. No. 7,566,292, shows a stirrup type handle rotatably connected to a hook.

Ledbetter, U.S. Pat. No. 4,756,527, shows a stirrup type handle connected to a strap with a connection hook thereon.

Hermelin, U.S. Pat. No. 4,979,731, shows a well known cable handle which only allows gripping and pulling longitudinally relative to the cable.

Campanaro et al., United States Patent Application No. US 2004/0248713, published Dec. 9, 2004, shows stirrup type handles 980 which are only attached at one end of the handle and include a bracket piece which bends toward the center of the handle for attachment to a cable at a spaced location from the center of the handle.

Bucknell et al., United States Patent Application No. US 2010/0124859, published May 20, 2010, discloses a complex compound rotational grip for a paddle shaft.

A variety of commercially available products are also available and known. Thirteen examples of such products will be identified and briefly discussed and all of these products except for examples 8, 10 and 11 may be seen on the web at http://www.exercise-equipment-parts.com and clicking on "cable attachments" from the menu on the left side of the page.

Example 1 is a Cable Crossover Handle—Open Sided—Swivel Handle.

Example 2 is a Cable Handle Attachment—Rubberized Grip.

Example 3 is Cable Crossover Handle—Knurled Swivel Handle.

Example 4 is a Cable Cross Over Attachment Handle—Swivel Knurled Grip.

Example 5 is a Nylon Strap Handle—Rubber Grip.

Example 6 is a Lat Low Row Strap—Black Nylon—Rubber Grips.

Example 7 is a Dual Handle Free-Action Chain Stirrup Cable Attachment.

Example 8 is another example of a Stirrup Handles and can be seen at http://www.newyorkbarbells.com/usa-5473.html.

Example 9 is a Lat Pull Down Attachment Handle—90 Degrees—Opposing Grip. Each of these Examples 1-7 and 9 show various forms of stirrup handles used in connection with exercise or exercise devices.

Example 10 is a Seated Row Double-D Handle with Contoured, Knurled Grips and can be seen at http:/www.sportsmith.net/ItemForm.aspx?Item=P16007. The functions of this device can be performed with the embodiment of the present invention shown in FIG. 4.

Example 11 is a Motion Transfer Cable Attachment and can be seen at http:/www.americanfitness.net/motiontransfercableattachment.aspx. The functions of this device can be performed with the embodiment of the present invention shown in FIGS. 3 and 10.

Example 12 shows Stamina Rotating Pull Up Handles which can be seen at http://www.americanfitness.net/pulluphandles.aspx. This device is similar to that shown in Hauser et al., U.S. Pat. No. 7,566,292 described above. The functions of these devices can be performed with the embodiment of the present invention shown in FIG. 11 which can be utilized with a hook member of the type shown in FIG. 7 of applicant's U.S. Pat. No. 7,008,355.

Example 13 is a Body Solid Ab Crunch Harness Cable. All of the above devices are of only general interest in that they relate to a pull down rather than a push down mechanics.

A particular exerciser for which the present invention has been created is to strengthen the triceps of a user. This has traditionally been accomplished by the use of triceps ropes which are gripping devices used for strengthening and conditioning the rear upper arm muscles more commonly referred to as the triceps. The muscles are stimulated by the bending and extension of arms at the elbow(s) against resistance as provided by the cable and weight stack machines to which triceps ropes are attached via a snap hook. Existing triceps ropes are designed to be gripped as one would a hammer, with the hand heels resting against rubber, plastic or wood knobs which prevent hand slippage under the load of resistance applied. FIG. 6 of the present invention shows a prior art traditional triceps rope with a user grasping the same. FIG. 6 is the most pertinent prior art known to applicant. The benefits of the existing triceps ropes is that of providing the user with an inexpensive, durable and easy to use training device. The primary drawback of the existing triceps ropes is due in large part to the "hammer" style grip which tends to disproportionately focus the bulk of applied resistance against the long head(s) of the triceps muscles, to the neglect of the lateral triceps head(s), which play a significant role in sports and resistance endeavors which require an open palm type grip. These activities include, for example, baseball, football and basketball. A secondary concern regarding the drawbacks associated with existing triceps ropes is that the thick inflexible rope hinders maximal skeletal joint articulation and exercise efficiency.

SUMMARY OF THE INVENTION

The hemispherical grip handle apparatus of the present invention provides users with a superior means of triceps conditioning than that provided by existing triceps ropes. The enhanced benefit is provided by the novel hemispherical gripping surface on which an "open palm" style grip may be employed thereby serving to equally distribute applied resistance to both the lateral and long heads of the triceps muscles, respectively. Additionally, the hemispherical grip handle device includes a thin, flexible latex sheath attachment cable which provides for optimal comfort and freedom of movement. This is a contrast to the thick, abrasive and inflexible rope that is common used in existing triceps ropes. Additionally, the provision of an enlarged hemispherical gripping surface can also accommodate a two handed grip option which could provide users with a previously unobtainable new exercise option and benefit beyond that made possible by existing triceps ropes. FIG. 7 of the present invention shows such an arrangement and is designed to replace a standard dumbbell overhead extension as shown in the topendsports website at http://topendsports.com/fitness/technique/overhead-extension-dumbbell.html. In this case a user would lie on his/her back on the floor (or on a bench) and grasp the gripping member 20 overhead and move the arms at the elbows in the direction of the arrow shown. This would replace and improve upon the dumbbell exercise described. A single enlarged grip apparatus of the type shown in FIG. 1 can be used with one or both hands at the same time or a double grip apparatus as shown in FIG. 2 can be used with both hands to lift the weight stack.

In its simplest form, the present invention provides a hemispherical grip handle apparatus comprising: a) a hemispherical grip member, said grip member having an outer convex hemispherical surface, said grip member and said outer surface having a grip member opening formed through the center and apex thereof; b) a length of aircraft cable having a first cable end extending through said grip member opening and having a second cable end extending transversely outward away from said grip member outer surface; c) a cable nut crimped onto said first cable end and positioned immediately against said grip member outer surface, said cable nut being larger than said grip member opening whereby securing said first cable end to said grip member; d) a connector attached to said second cable end; and e) a length of flexible tubing surrounding said cable, said length of tubing extending from said grip member outer surface to said connector, whereby when a user grasps the grip member outer surface, said cable and tubing pass between two fingers of the user.

In one embodiment, an outer grip layer is provided which may be in the form of a rubberized surface. In a preferred embodiment, the outer grip layer is in the form of a painted surface or more preferably a layer of textured paint.

Preferably, the length of flexible tubing is longer than a distance from said grip layer to said connector whereby said length of tubing is compressed between said grip layer and said connector causing a gapless tight fit at an interface of the latex tubing and the grip layer.

In a preferred embodiment the flexible tubing is formed of latex although it may be formed of vinyl or any other soft flexible material.

The connector preferably employs a crimp style cable nut having a first nut opening and second nut opening and a cable thimble with said second cable end extending though said first nut opening, thence around said thimble and thence through said second nut opening and being crimped in place. In one embodiment, the second cable end extends through said second nut opening and forms the second end of a second hemispherical grip member whereby two hemispherical grip handle devices are connected to a single connector.

Preferably, when a user grasps the grip member outer surface, the fingers and palm of the hand of a user will cover at least 50% of the surface area of said hemispherical surface. Covering at least 70% of the surface area is preferred. A largest diameter of said grip member is preferably greater than a palm width of a user.

Preferably, the grip member is hollow and has a concave inner surface and has a wall thickness of less than ¼ of an inch. In this case, it is preferred that the grip member is formed of steel although plastic, wood or other material may be used.

Alternatively, the grip member is solid and has a circular planar surface opposite said hemispherical surface.

When a solid grip member is employed, the grip member is preferably formed of rubber, plastic or wood.

DETAILED DESCRIPTION OF THE PREFERRED EMBODIMENTS

Figure 1:
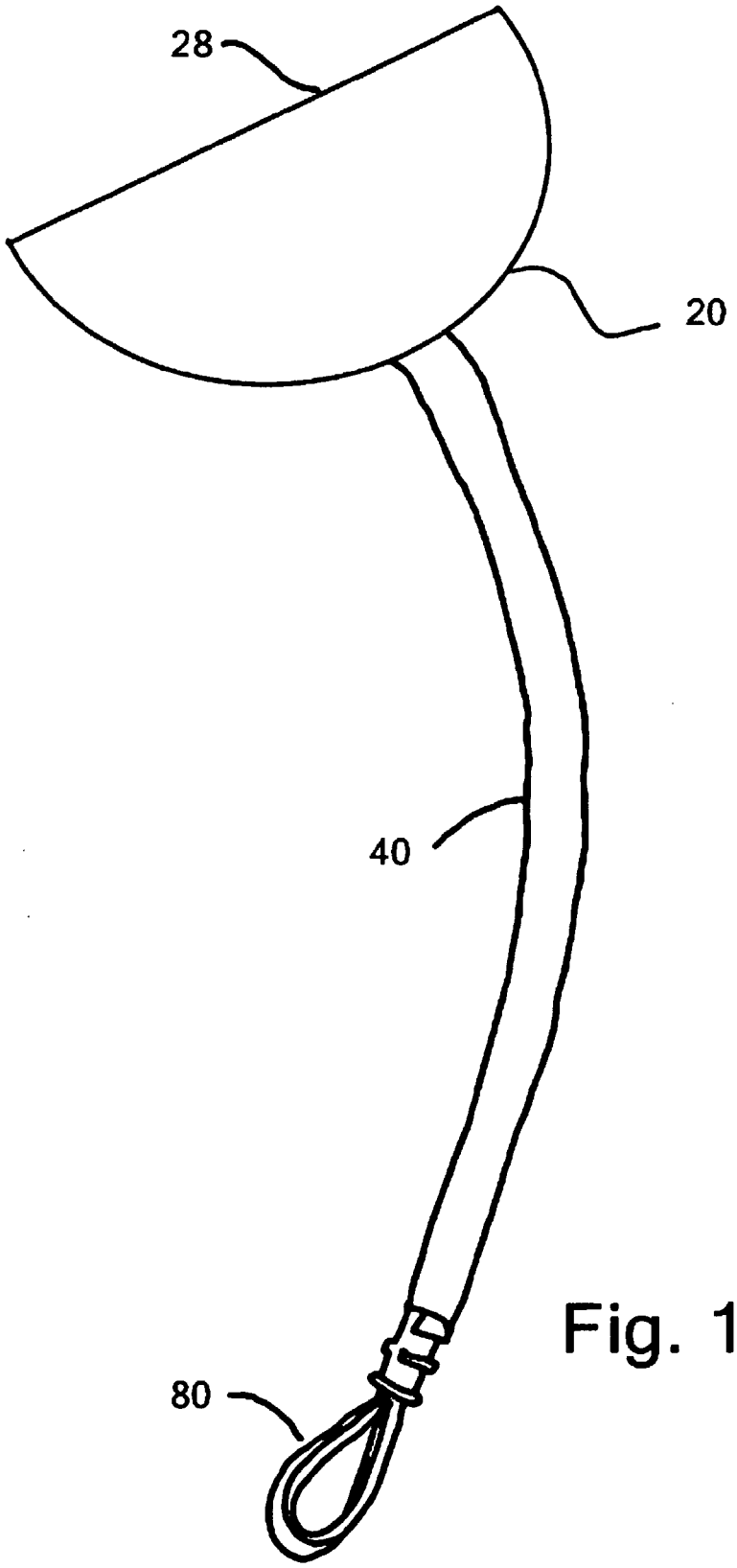
FIG. 1 is a perspective view showing the hemispherical grip handle apparatus of the present invention.

FIG. 1 shows the major components of the presently preferred embodiment of the present invention including hemispherical grip member 20, a soft coated cable 40 and a connector 80. The largest diameter of the grip member is shown at 28.

Figure 2:
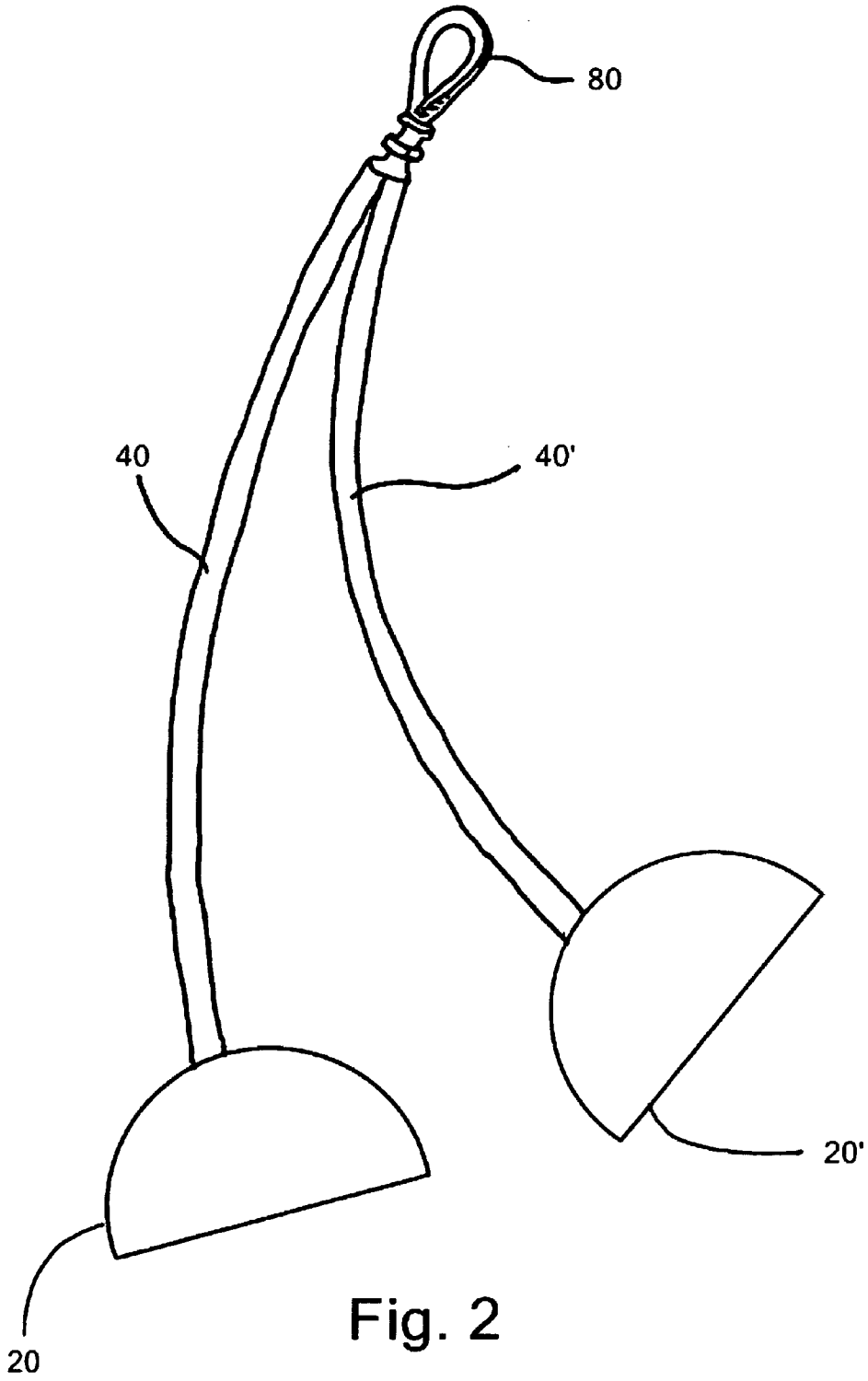
FIG. 2 is a perspective view of an apparatus according to the present invention having two hemispherical grip handles with cables connected to a single connector.

FIG. 2 shows an alternative embodiment in which a pair of grip members 20 and 20' and corresponding coated cables 40 and 40' are connected to a single connector 80. This allows for the user to use both members 20 and 20' to pull through two cables 40 and 40' connected to the same connection point 80.

Figure 3:
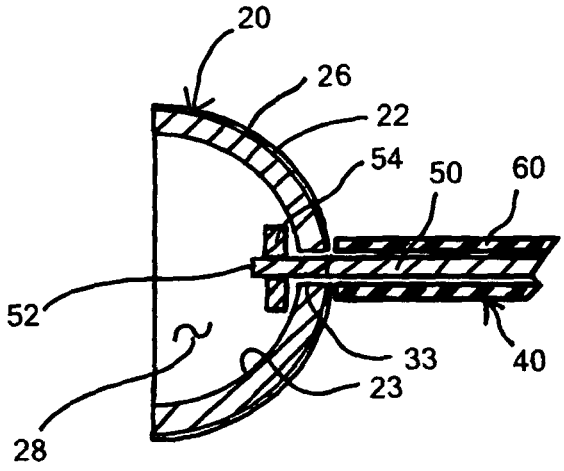
FIG. 3 is a cross sectional view of the hemispherical grip handle and first end of the cable of the present invention.

As shown in FIG. 3, the present invention has a hollow grip member 20 which includes a convex outer hemispherical surface 22 (referred to herein as the "grip member outer surface 22") and an inner concave hemispherical surface 23. An empty space 28 exists within the concave surface 23. The grip member is preferably formed of steel with a wall thickness between 1/16 and 1/4 of an inch. A wall opening 33 extends through the wall of the grip member at the center and apex thereof. An outer grip layer 26 is preferably provided on or over the grip member outer surface 22. This grip layer 26 may be in the formed of paint or textured paint, a layer of foam material, tape, or any other material layer which provides an increased and more comfortably grip than gripping the steel tube directly.

The cable 40 includes a length of aircraft cable or wire rope 50 which has a first cable end 52 which extends through the grip handle wall opening 23 and into the empty space 28 where a cable nut 54 is crimped onto the first cable end 52. A second cable end 56 extends transversely outward away from the handle 20 and the grip layer 26.

A length of flexible tubing 60 surrounds the cable 50. The tubing which is preferably formed of a soft material such as latex or vinyl 60 extends from the grip layer 30 to a connector 80. The provision of a soft, flexible tubing 60 is critical to the present invention since such tubing provides a cushion and protects the hands and fingers of a user from the rough steel cable.

Figure 9A:
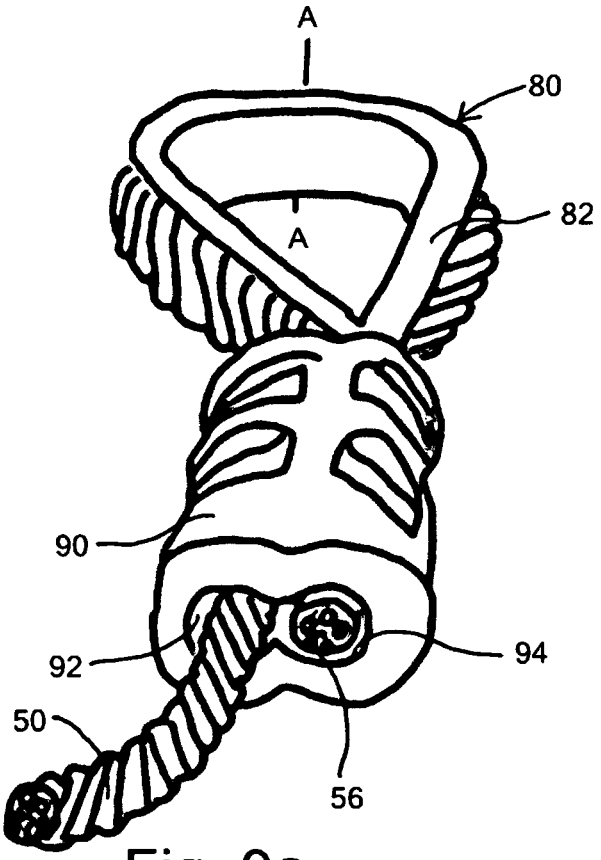
Fig. 9a PRIOR ART
FIGS. 9*a* and 9*b* show a prior art connector for use with the present invention.
Figure 9B:
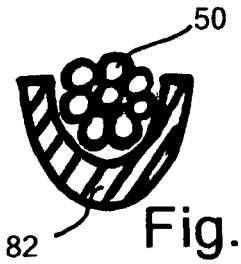

The present invention can be used with any kind of connector which can be a simple hook attached to the second cable end 56. Preferably, however, the presently preferred connector is a well known prior art cable connector 80 as shown in FIGS. 9*a* and 9*b*. This connector 80 includes a crimp style cable nut 90 having a first nut opening 92 and a second nut opening 94. A tear shaped cable thimble 82 is provided with the second cable end 56 extending through the first nut opening 92 thence around the thimble 82 and thence through the second nut opening 94 with said cable nut 90 being crimped to hold the cable end 56 firmly in place. As shown in FIGS. 1 and 2, respectively, this type of connector 80 can be used to connect one or two cables 40, 40'.

Figure 4A:
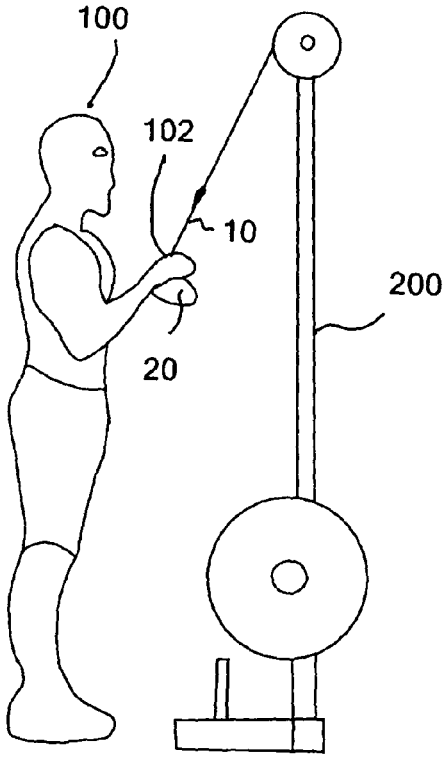
FIGS. 4*a* and 4*b* are side views showing the present invention attached to an exercise machine and showing the movement of a user.
Figure 4B:
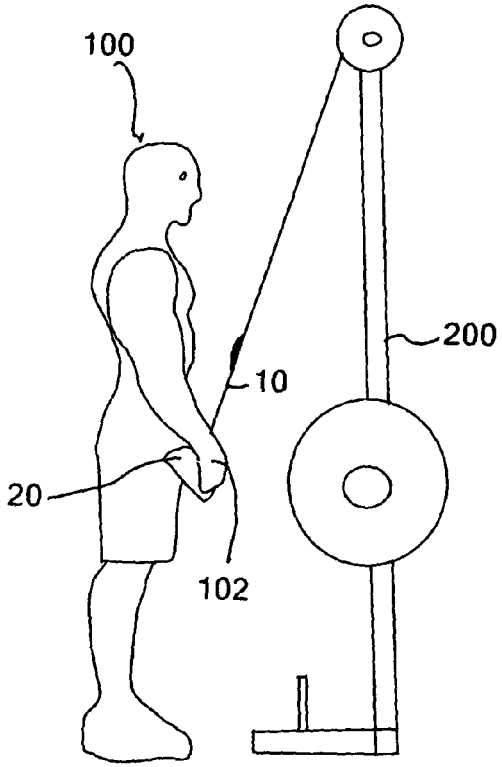

FIGS. 4*a* and 4*b* show a user 100 using his hand 102 to push downwardly on a hemispherical grip member apparatus 10 (including hemispherical grip member 20) attached to an exercise machine 200.

Figure 5:
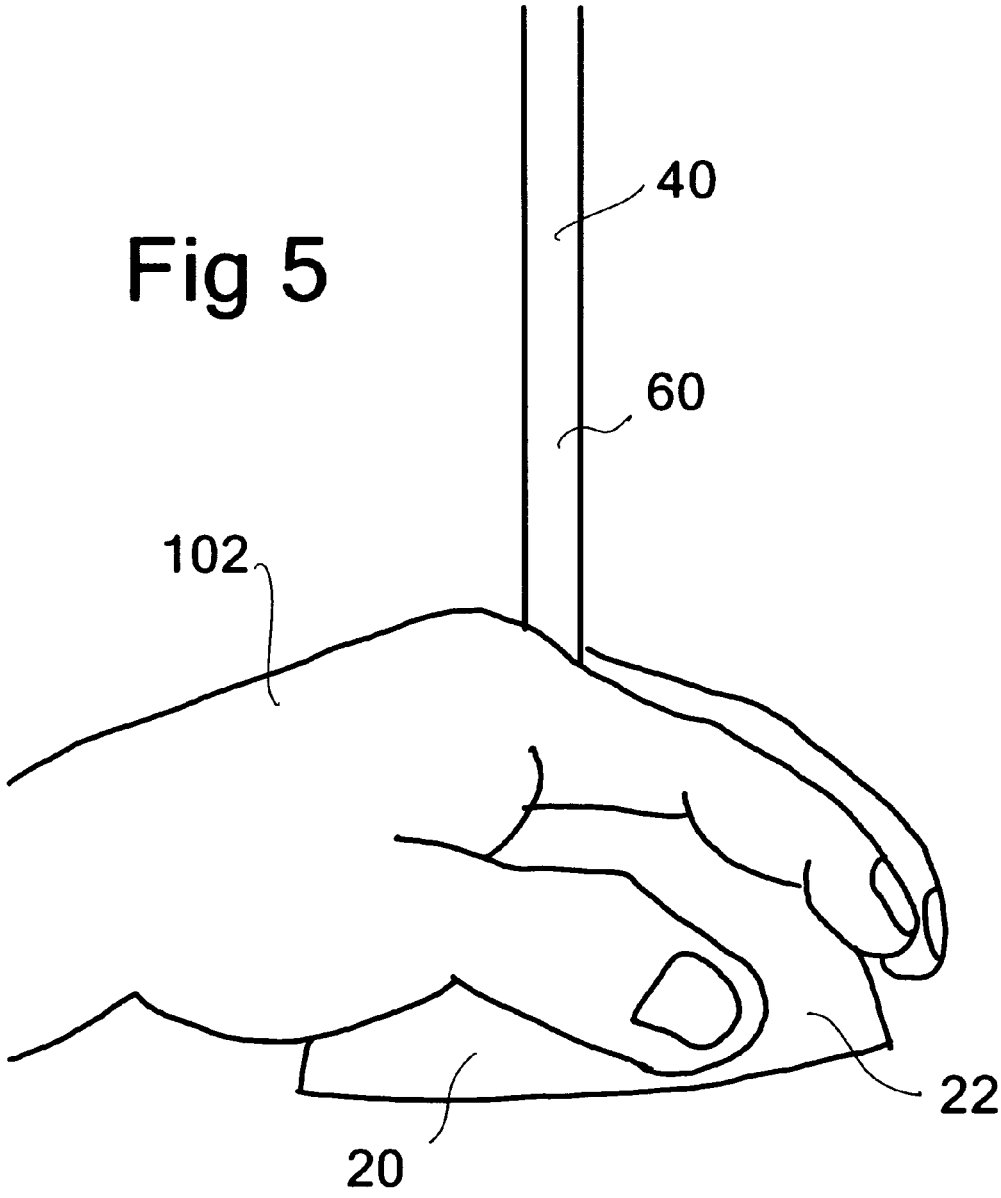
FIG. 5 is a perspective view showing the hand of a user gripping a hemispherical grip member with the cable passing between the fingers of the user and also showing greater that 70% coverage of the hemispherical surface covered.

FIG. 5 shows the open palm style grip or grasp of the hand 102 of user holding onto the outer hemispherical surface 22 of the grip member 20. The cable 40 which is surrounded by flexible tubing 60 is shown passing between the index finger and middle finger of the users hand 102. As shown more that 70% of the outer surface 22 is covered by the fingers and palm of the user's hand 102. The cable may pass between any two fingers although these two are preferred. In any case, the user will be able to firmly and safely grasp the handle member 20 and have a great deal of control over how the load is lifted. Because the cable 40 is connected within the grasping hand of the user, the user's hand 102 is required to stabilize the load by using various muscles in the forearm, hand, wrist and fingers. The hand can move at the wrist in virtually any direction and the use of the present invention not only strengthens and tones the forearm, hand, fingers and wrist but also makes the use of a variety of existing exercise machines more safe and easy to use by providing a proper handle which is not restricted to any particular path but which can be freely angled by the users hand muscles during any lifting activity.

As shown in FIGS. 1 and 3 and 5, because of the soft flexible tubing 60 provided over the cable or wire rope 50, the hand of a user is protected from abrasion from the cable. This allows a grip location directly over the connection point of the cable 40 to the handle 20. When the flexible tubing 60 is properly sized (i.e. slightly longer than and compressed slightly between the handle member 20 and connector 80), a tight joint is formed at the interface between the end of the flexible tubing and the grip member outer surface 26 the grip member 20. This prevents any pinching of the skin at the location of such interface.

Figure 6:
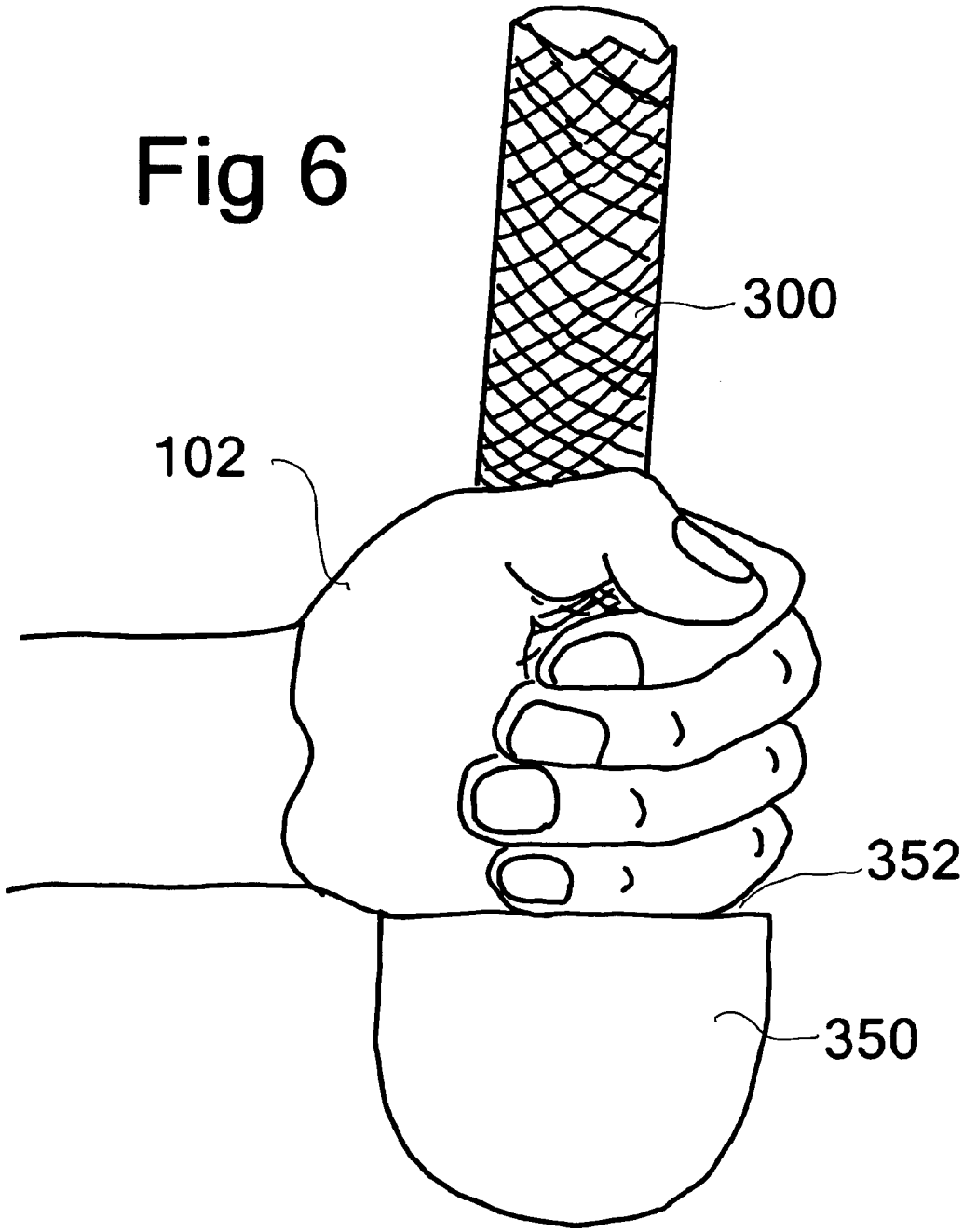
Prior Art Fig 6
FIG. 6 is a perspective view of a prior art triceps rope.

FIG. 6 shows a prior art triceps rope for which the present invention was created to replace.

Figure 7:
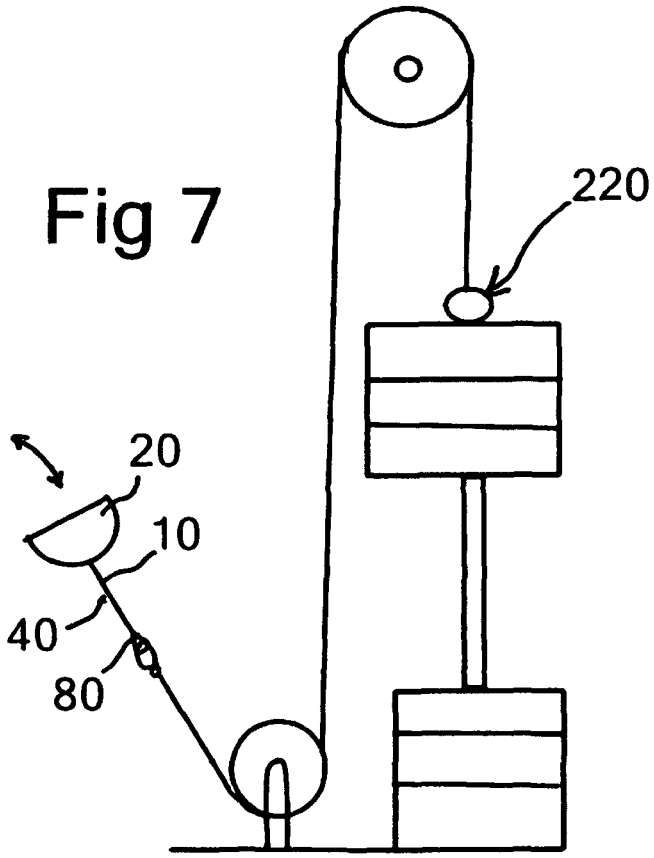
FIG. 7 is a side view of the hemispherical grip member apparatus as connected with a cable to a weight stack exercise machine for an overhead extension exercise.

As mentioned above, FIG. 7 of the present invention shows such an arrangement and is designed to replace a standard dumbbell overhead extension exercise. In this case a user would lie on his/her back on the floor (or on a bench) and grasp the gripping member 20 overhead and move the arms at the elbows in the direction of the arrow shown. This would replace and improve upon the dumbbell exercise described. A single grip apparatus as shown in FIG. 1 can be used with one or both hands at the same time or a double grip apparatus as shown in FIG. 2 can be used with both hands to lift the weight stack.

Figure 8:
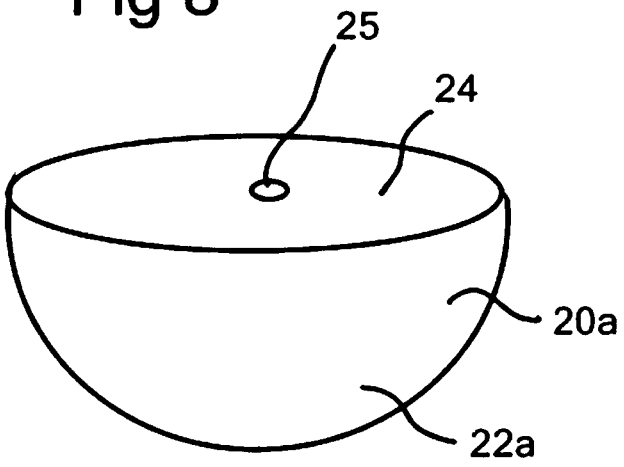
FIG. 8 is a perspective view showing a solid hemispherical grip member.

FIG. 8 shows a solid version of the grip member 20*a* in which an outer convex hemispherical surface 22*a* is provided on one side and a planar circular surface 24 is provided on the opposite side. An opening 25 extends from the apex of the surface 22*a* to the center of the surface 25 through which a cable can be attached.

It is to be understood that while certain forms of the present invention have been illustrated and described herein, the present invention is not to be limited to the specific forms or arrangements of parts described and shown.

I claim:

1. A hemispherical grip handle apparatus comprising:

a) a hemispherical grip member, said grip member having an outer hemispherical surface, said grip member and said grip member outer surface having a grip member opening formed through the center and apex thereof;

b) a length of aircraft cable having a first cable end extending through said grip member opening and having a second cable end extending transversely outward away from said grip member outer surface;

c) a cable nut crimped onto said first cable end and positioned immediately against said grip member, said cable nut being larger than said grip member opening whereby securing said first cable end to said grip member;

d) a connector attached to said second cable end; and e) a length of flexible tubing surrounding said cable, said length of tubing extending from said grip member outer surface to said connector, whereby when a user grasps the grip member outer surface, said cable and tubing pass between two fingers of the user.

2. A hemispherical grip handle apparatus according to claim 1 wherein said grip member further comprises an outer grip layer in the form of a rubberized surface.

3. A hemispherical grip handle apparatus according to claim 1 wherein said grip member further comprises an outer grip layer in the form of a painted surface.

4. A hemispherical grip handle apparatus according to claim 3 wherein said outer grip layer further comprises a layer of textured paint.

5. A hemispherical grip handle apparatus according to claim 1 wherein said length of flexible tubing is longer than a distance from said grip member outer surface to said connector whereby said length of tubing is compressed between said grip member outer surface and said connector causing a gapless tight fit at an interface of the latex tubing and the grip member outer surface.

6. A hemispherical grip handle apparatus according to claim 1 wherein said flexible tubing is formed of latex.

7. A hemispherical grip handle apparatus according to claim 1 wherein said flexible tubing is formed of vinyl.

8. A hemispherical grip handle apparatus according to claim 1 wherein said connector further comprises a crimp style cable nut having a first nut opening and second nut opening and a cable thimble with said second cable end extending though said first nut opening, thence around said thimble and thence through said second nut opening and being crimped in place.

9. A hemispherical grip handle apparatus according to claim 8 wherein said second cable end extends through said second nut opening and forms the second hemispherical grip handle apparatus whereby two hemispherical grip handle devices are connected to a single connector.

10. A hemispherical grip handle apparatus according to claim 1 wherein when a user grasps the grip member outer surface, fingers and palm of a hand of a user will cover at least 50% of a surface area of said hemispherical surface.

11. A hemispherical grip handle apparatus according to claim 1 wherein when a user grasps the grip member outer surface, fingers and palm of a hand of a user will cover at least 70% of a surface area of said hemispherical surface.

12. A hemispherical grip handle apparatus according to claim 1 wherein a largest diameter of said grip member is greater than a palm width of a user.

13. A hemispherical grip handle apparatus according to claim 1 for use with a two handed grip wherein a largest diameter of said grip member is greater than two times a palm width of a user.

14. A hemispherical grip handle apparatus according to claim 1 wherein said grip member is hollow and has a concave inner surface and has a wall thickness of less than ¼ of an inch.

15. A hemispherical grip handle apparatus according to claim 14 wherein said grip member is formed of steel.

16. A hemispherical grip handle apparatus according to claim 1 wherein said grip member is solid and has a circular planar surface opposite said hemispherical surface.

17. A hemispherical grip handle apparatus according to claim 16 wherein said grip member is formed of rubber, plastic or wood.

* * * * *